US006223352B1

(12) United States Patent
Watlington

(10) Patent No.: US 6,223,352 B1
(45) Date of Patent: May 1, 2001

(54) INFANT CLOTHING

(76) Inventor: Mary Watlington, 56 Lake Dr., P.O. Box 334, Roosevelt, NJ (US) 08555-0334

( * ) Notice: Subject to any disclaimer, the term of this patent is extended or adjusted under 35 U.S.C. 154(b) by 0 days.

(21) Appl. No.: 09/627,416

(22) Filed: Jul. 27, 2000

Related U.S. Application Data

(60) Provisional application No. 60/185,698, filed on Feb. 29, 2000.

(51) Int. Cl.[7] ..... A41D 11/00

(52) U.S. Cl. ..... 2/80; 2/83

(58) Field of Search ..... 2/80, 83, 69, 75, 2/79, 73, 74, 78.1, 78.2, 78.4, 111, 114, 227, 228, 238

(56) References Cited

U.S. PATENT DOCUMENTS

| | | | | |
|---|---|---|---|---|
| 2,227,214 | | 12/1940 | Bisberg . | |
| 2,714,718 | * | 8/1955 | Kramer | 2/75 |
| 2,725,565 | * | 12/1955 | Wyner | 2/83 |
| 2,985,887 | | 5/1961 | Lindley . | |
| 3,002,193 | * | 10/1961 | Briskman | 2/80 |
| 3,064,265 | * | 11/1962 | Bridgewaters | 2/75 |
| 3,665,516 | | 5/1972 | Orovan . | |
| 4,149,275 | | 4/1979 | Sanchez . | |
| 4,259,751 | | 4/1981 | Drmaj . | |
| 4,989,282 | | 2/1991 | Goldstein . | |
| 5,170,505 | | 12/1992 | Rohrer . | |
| 5,367,709 | | 11/1994 | Teasley . | |
| 5,708,977 | | 1/1998 | Morkunas . | |

FOREIGN PATENT DOCUMENTS

| | | |
|---|---|---|
| 2433913 | 8/1978 | (FR) . |
| 1589300 | 5/1981 | (GB) . |

* cited by examiner

*Primary Examiner*—Gloria M. Hale
(74) *Attorney, Agent, or Firm*—Richard C. Litman

(57) ABSTRACT

An adjustable clothing ensemble for an infant comprises a top portion and a bottom portion. Plural horizontal rows of fasteners are disposed on the top portion. A single horizontal row of fasteners is positioned on the bottom portion such that the length of the ensemble may adjusted as the infant grows.

2 Claims, 2 Drawing Sheets

INFANT CLOTHING

CROSS-REFERENCE TO RELATED APPLICATION

This application claims the benefit of U.S. Provisional Patent Application Ser. No. 60/185,698, filed Feb. 29, 2000.

BACKGROUND OF THE INVENTION

1. Field of the Invention

The present invention generally relates to wearing apparel.

More specifically, the present invention is drawn to an ensemble to be worn by an infant or toddler. The ensemble incorporates structure for adjusting the length thereof so that the ensemble will fit as the infant/toddler grows.

2. Description of Related Art

Providing clothing for a growing infant/toddler can be an expensive proposition for caring parents. The "growth spurts" occur so rapidly that the romper suits are too small after minimal wear and new ones must be purchased. An ensemble that may be easily adjusted to correspond with the growth spurts would allow the ensemble to be used for a longer period, thereby eliminating the necessity for additional shopping trips and easing the strain on the family budget.

There are many patents in the prior art that disclose means for adjusting garment length. For example, U.S. Pat. No. 2,227,214 (Bisberg) and U.S. Pat. No. 2,985,887 (Lindley) show respective means for adjusting the hem of a woman's undergarment and adjusting the hem of a skirt. In both instances, time-consuming stitching is involved.

U.S. Pat. No. 3,665,516 (Orovan) and U.S. Pat. No. 4,149,275 (Sanchez) show fastening means used when adjusting the hem of a single garment to be worn by a woman. Each patent requires that the hem be folded and fastened.

U.S. Pat. No. 4,259,751 (Drmj) shows means for adjusting the cuff on a young man's trousers. Time-consuming folding and stitching are involved.

VELCRO strips are utilized to increase the size of a garment as shown in U.S. Pat. No. 5,170,505 (Rohrer).

U.S. Pat. No. 5,367,709 (Teasley) and U.S. Pat. No. 5,708,577 (Morkunas) respectively disclose draw strings and expandable seams for altering the size of garments.

U.S. Pat. No. 4,989,282 (Goldstein) shows a mummy-type sleeping bag that includes additional component sections that allow the bag to be extended to fit a growing child.

British Patent number 1,589,300 and French Patent number 2,433,913 show garments with replaceable limb (arm, leg) pieces.

None of the above inventions and patents, taken either singly or in combination, is seen to disclose an adjustable ensemble for infants'/toddlers' wear as will subsequently be described and claimed in the instant invention.

SUMMARY OF THE INVENTION

The present invention is an ensemble comprising a top portion and a bottom portion. The ensemble is adjustably sized to be worn by an infant/toddler in the age range of approximately three to twelve-plus months. As contemplated, the ensemble has at least three adjustment levels. It is obvious however, that more or fewer levels might be employed if desired. Depending on the child's size, level one would be suitable for an infant/toddler from three-six months; level two, from six-nine months; level three, from nine-twelve+ months. The top of the ensemble is provided with three horizontal rows of fasteners. The bottom of the ensemble has a single row of complimentary fasteners. The top and bottom can be made in coordinating solids and/or prints such that one bottom could be fashionably worn with a variety of tops and vice versa. The ensemble will be made from any suitable material, however a washable, stretchy material, e.g. cotton, has proven to be most appropriate.

Accordingly, it is a principal object of the invention to provide an ensemble to be worn by infants/toddlers, which ensemble may be utilized from an age of approximately three months to an age of twelve-plus months.

It is another object of the invention to provide an ensemble for infants/toddlers, which ensemble has an adjustable length.

It is a further object of the invention to provide an ensemble for infants/toddlers, which ensemble is easily adjustable.

Still another object of the invention is to provide an ensemble for infants/toddlers, which ensemble employs quick release fasteners to facilitate adjustment.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
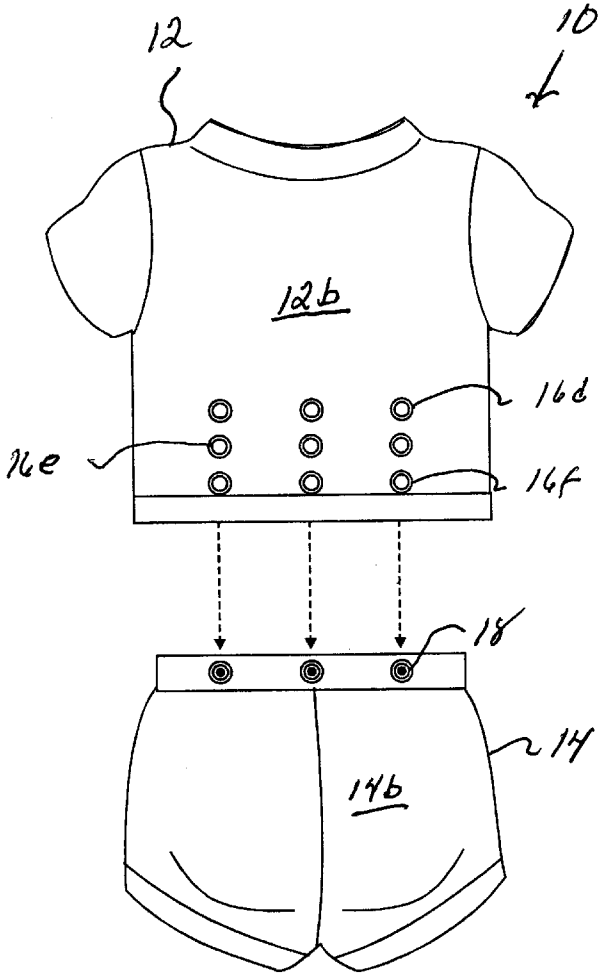
FIG. 2 is an exploded rear view of an infant's/toddler's adjustable ensemble according to the present invention.
Figure 1:
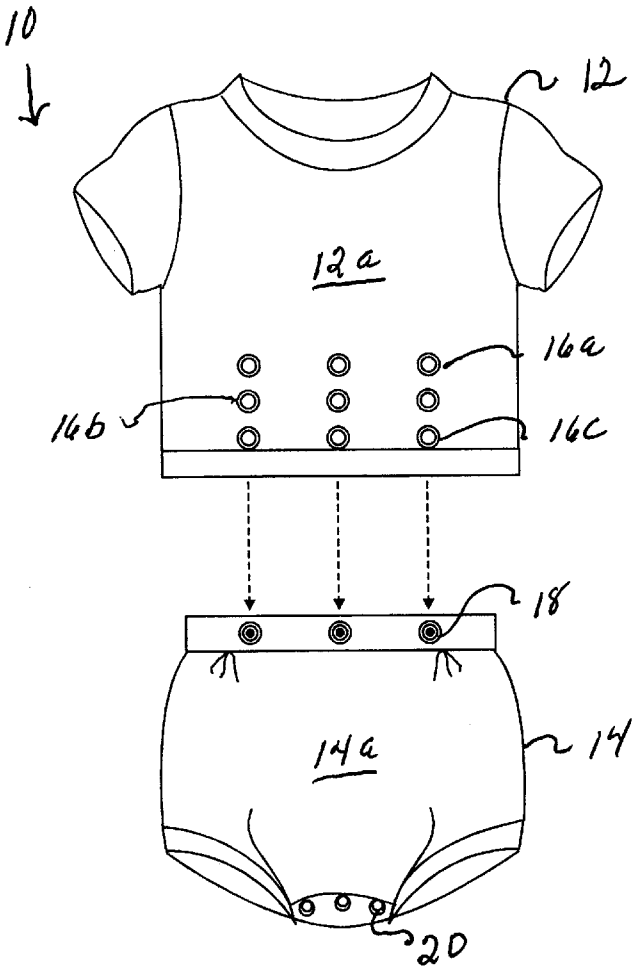
FIG. 1 is an exploded front view of an infant's/toddler's adjustable clothing ensemble according to the present invention.

The present invention, as best shown in FIGS. 1 and 2, comprises an infant's/toddler's ensemble indicated generally at 10. The ensemble includes a top portion 12 and a bottom portion 14. Portions 12, 14 are conventional having the usual torso, arm and leg parts required in infants'/toddlers' clothing. As stated above, the ensemble can be fabricated of any material approved and suitable for infant wear. An array of fasteners are disposed on the front face 12*a* of top portion 12. The fasteners are arranged in three horizontal rows 16*a*, 16*b* and 16*c*. In the preferred embodiment the fasteners take on the form of conventional female snap fasteners. The fasteners are positioned so that the receiving end is on the inside surface of front face 12*a*. Three horizontal rows of fasteners 16*d*, 16*e* and 16*f* are similarly arranged on the rear face 12*b* of top 12.

A single row of conventional male snap fasteners 18 is positioned on the front 14*a* and rear 14*b* faces of bottom portion 14. The male fasteners are positioned so that the insertion part extends outward from the respective front and rear faces of portion 14. Although snap fasteners are preferred, it is recognized that other known fasteners (buttons, zippers, hook and loop, etc.) may be effectively utilized in the practice of the instant invention.

Additional fasteners 20 are employed at the crotch of bottom portion 14 to facilitate diaper changing and/or potty training.

Figure 5:
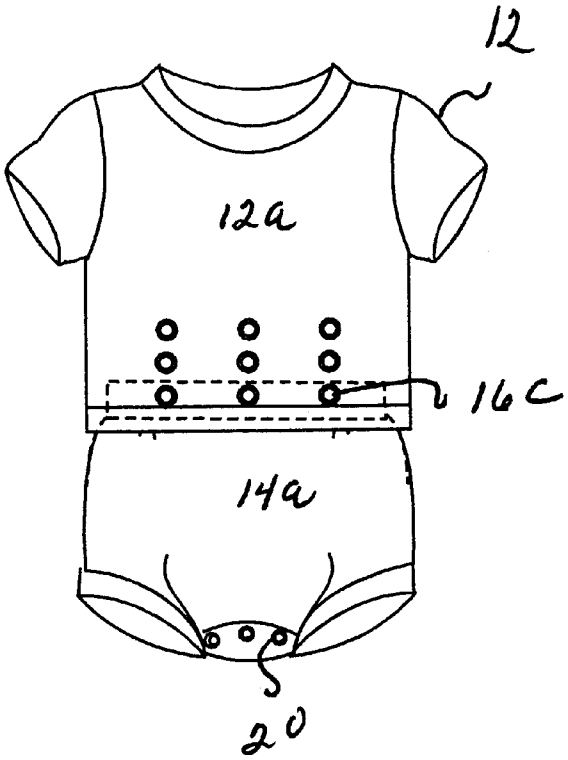
FIG. 5 is a front view of an infant's/toddler's adjustable ensemble adjusted to its longest length (large).
Figure 4:
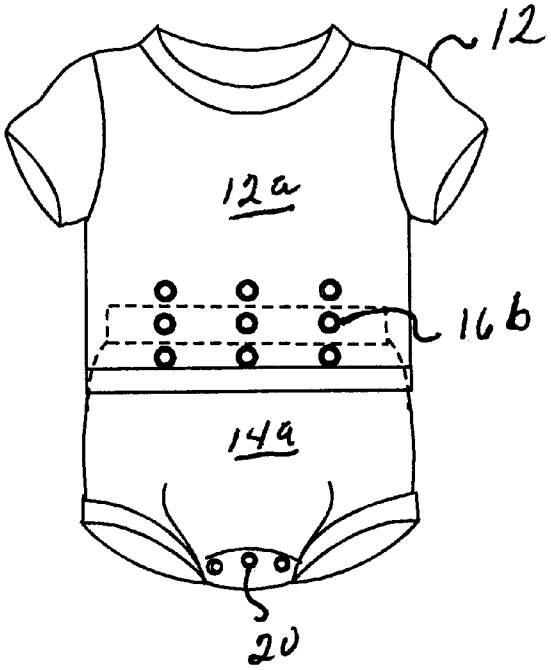
FIG. 4 is a front view of an infant's/toddler's adjustable ensemble adjusted to its intermediate length (medium).
Figure 3:
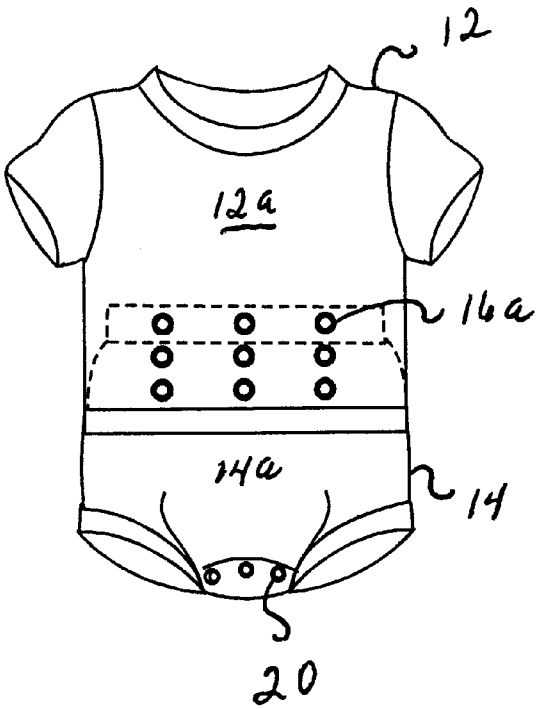
FIG. 3 is a front view of an infant's/toddler's adjustable ensemble adjusted to its shortest length (small).

In use, ensemble 10 may assume a position, as illustrated in FIG. 3 (small), to fit an infant/toddler in an age range from three to six months. In this instance male fasteners 18 are snapped into the female fasteners on rows 16*a* (front) and 16*d* (rear-not shown). In FIG. 4 the ensemble is adjusted to fit an infant/toddler age six to nine months (medium). Fasteners 18 would be snapped into the fasteners of row 16*b* (front) and 16*e* (rear-not shown). As shown in FIG. 5, the ensemble's longest length (large), fasteners 18 would be snapped into the fasteners of row 16*c* (front) and 16*f* (rear-not shown) allowing the ensemble to fit an infant age nine to twelve-plus months.

It is to be understood that the present invention is not limited to the sole embodiment described above, but encompasses any and all embodiments within the scope of the following claims.

I claim:

1. An infant's/toddler's clothing ensemble comprising:

a top portion fabricated of soft pliable material, said top portion having a front inner surface, a front outer surface, a rear inner surface and a rear outer surface;

a bottom portion fabricated of soft pliable material, said bottom portion having a front face, a rear face and a crotch area;

a single horizontal row of male snap fasteners positioned on said front face and said rear face of said bottom portion;

three horizontal rows of female snap fasteners, said female snap fasteners having receiving ends disposed on said front inner surface and said rear inner surface of said top portion; and means for fastening and unfastening said crotch area.

2. An infant's/toddler's clothing ensemble as recited in claim 1, wherein said means for fastening and unfastening said crotch area comprises male and female snap fasteners.

* * * * *